US005220900A

United States Patent [19]

Wakeman

[11] Patent Number: 5,220,900

[45] Date of Patent: Jun. 22, 1993

[54] AIR ASSIST ATOMIZER FOR FUEL INJECTOR

[75] Inventor: Russell J. Wakeman, Newport News, Va.

[73] Assignee: Siemens Automotive L.P., Auburn Hills, Mich.

[21] Appl. No.: 819,336

[22] Filed: Jan. 15, 1992

Related U.S. Application Data

[63] Continuation-in-part of Ser. No. 769,747, Oct. 2, 1991, abandoned, which is a continuation of Ser. No. 652,166, Feb. 7, 1991, abandoned.

[51] Int. Cl.[5] ..... F02M 69/08; F02M 51/00

[52] U.S. Cl. ..... 123/531; 239/405; 123/472; 123/585; 123/590

[58] Field of Search ..... 123/472, 531, 532, 533, 123/534, 585, 590; 239/296, 298, 403, 405, 416.5, 417.3

[56] References Cited

U.S. PATENT DOCUMENTS

| | | | |
|---|---|---|---|
| 3,656,693 | 4/1972 | Eckert | 239/410 |
| 4,006,719 | 2/1977 | Kanda et al. | 239/403 |
| 4,046,121 | 9/1977 | Pieriot | 123/442 |
| 4,311,277 | 1/1982 | Stratton | 239/403 X |
| 4,434,766 | 3/1984 | Matsuoka et al. | 239/403 X |
| 4,465,050 | 8/1984 | Igashira et al. | 123/531 X |
| 4,519,370 | 5/1985 | Iwata | 123/432 |
| 4,600,151 | 7/1986 | Bradley | 239/400 |
| 4,938,417 | 7/1990 | Halvorsen | 123/531 X |
| 4,945,877 | 8/1990 | Ziegler et al. | 123/472 |
| 4,974,571 | 12/1990 | Oppenheim et al. | 123/531 |

FOREIGN PATENT DOCUMENTS 4004897 2/1990 Fed. Rep. of Germany .

*Primary Examiner*—Willis R. Wolfe

*Attorney, Agent, or Firm*—George L. Boller; Russel C. Wells

[57] ABSTRACT

The atomizer fits over the outlet of the fuel injector and comprises a thimble-shaped inner part that nests within a thimble-shaped outer part. Both inner and outer parts comprise holes in their end walls through which injected liquid fuel from the injector outlet passes. The inner and outer parts cooperatively define passages through which assist air is conveyed to the aforementioned holes to aid in the atomization of the injected fuel. Several embodiments of atomizers are disclosed.

20 Claims, 6 Drawing Sheets

AIR ASSIST ATOMIZER FOR FUEL INJECTOR

REFERENCE TO RELATED APPLICATIONS

This application is a continuation-in-part of commonly assigned Ser. No. 07/769,747, filed Oct. 2, 1991, (abandoned), which is a continuation of commonly assigned Ser. No. 07/652,166, filed Feb. 7, 1991, (abandoned).

FIELD OF THE INVENTION

This invention relates generally to fuel injectors of the type that are used to inject liquid fuel into the induction system of an internal combustion engine and particularly to an atomizer that fits over the tip end of such a fuel injector and serves to convey air to the exterior of the injector tip end to promote the atomization of the liquid fuel emitted by the fuel injector from its tip end.

BACKGROUND AND SUMMARY OF THE INVENTION

Air assist atomization of the liquid fuel emitted from the tip end of a fuel injector is a known technique that is used to promote better preparation of the combustible air/fuel mixture that is introduced into the combustion chambers of an internal combustion engine. A better mixture preparation promotes both a cleaner and a more efficient combustion process, a desirable goal from the standpoint of both exhaust emissions and fuel economy.

The state of the art contains a substantial number of patents relating to air assist atomization technology. The technology recognizes the benefits that can be gained by the inclusion of special assist air passages that direct the assist air into interaction with the injected liquid fuel. Certain air assist fuel injection systems use pressurized air, from either a pump or some other source of pressurization, as the assist air. Other systems rely on the pressure differential that exists between the atmosphere and the engine's induction system during certain conditions of engine operation. It is a common technique to mount the fuel injectors in an engine manifold or fuel rail which is constructed to include assist air passages for delivering the assist air to the individual injectors.

Insofar as the applicant is aware from preliminary novelty searching of the present invention, the practices of the prior art for defining the final length of the assist air passage to the injector tip involve the use of either special fuel injectors or special fuel rail or manifold assemblies to cooperatively define the final length of the passage, or else the addition of a single part that either per se or in cooperation with the adjacent structure provides the definition. The following U.S. patents which were developed in preliminary novelty searching are typical of these practices: 3,656,693; 4,046,121; 4,519,370; and 4,945,877.

The present invention relates to novel air assist atomizers in which the definition of the final length of the assist air passage to each fuel injector tip is provided by the cooperative organization and arrangement of two additional parts which form an atomizer assembly disposed between the tip end of an injector and the wall of a socket that receives the injector. One advantage of the present invention is that it adapts an otherwise conventional electrically-operated fuel injector for use in an air assist system without the need to make modifications to the basic injector, and without the need to make special accommodations in the injector-receiving socket other than suitably dimensioning the socket to accept the atomizer assembly on the tip end of the injector. Another advantage of the invention is the ability to configure the final length of the air assist passage to an injector in any of a number of different ways. Certain of these configurations possess their own individually unique attributes, as will be seen in the ensuing detailed description of each of a number of different embodiments of the invention. The drawings which accompany this disclosure illustrate presently preferred embodiments of the invention according to the best mode contemplated at the present time in carrying out the invention.

BRIEF DESCRIPTION OF THE DRAWINGS

FIG. 23 is a similar cross-sectional view as FIG. 22 showing the air assist turned on.

DESCRIPTION OF THE PREFERRED EMBODIMENT

Figure 1:
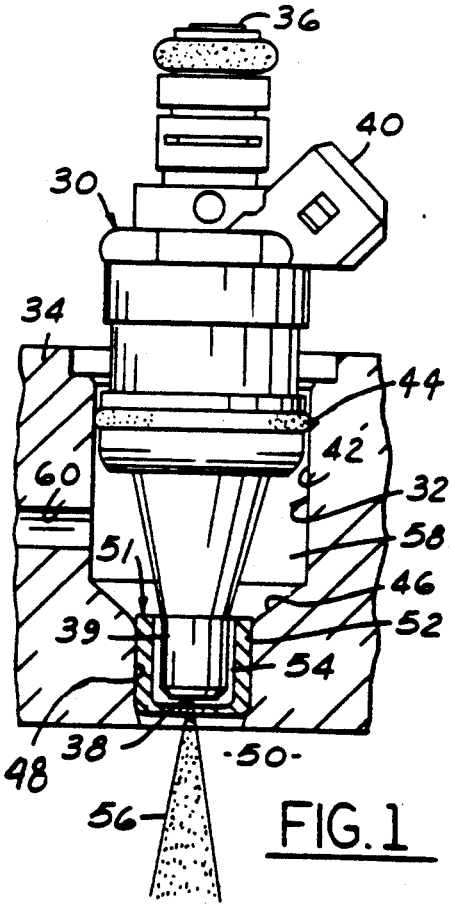
FIG. 1 is an elevational view partly in cross section through a manifold socket containing a fuel injector having one embodiment of the air assist atomizer of the present invention.

FIG. 1 shows a top-feed, solenoid-operated fuel injector 30 mounted in a socket 32 of an engine manifold assembly 34. The engine also has a fuel rail (not shown) which is also associated with fuel injector 30 to deliver pressurized liquid fuel to the injector's fuel inlet 36 which is at one axial end of the injector. Socket 32 is suitably shaped to accept a portion of the injector that is adjacent the opposite axial end of the injector, including the injector's fuel outlet 38 which is at the injector tip end 39. The injector's electrical connector 40 remains exterior of socket 32 to be accessible for connection to a mating connector of a wiring harness (not shown) via which the injector's solenoid is operated from an electronic engine control.

Socket 32 is in the form of a through-bore which comprises a main circular cylindrical segment 42 to which the fuel injector is sealed by means of a circular O-ring 44. The more interior portion of socket 32 comprises a frusto-conical segment 46 which tapers radially inwardly from segment 42 to a circular cylindrical segment 48 that is open to a main air induction passage 50 of the engine. Passage 50 leads to the engine's combustion chamber space (not shown). The injector's tip end 39 is fitted to segment 48 by means of a two-part atomizer assembly 51 consisting of an outer part 52 and an inner part 54. Together the two parts 52 and 54 cooperatively define passage means for the conveyance of assist air to act on the liquid fuel spray 56 at the point of its emission from outlet 38 for the purpose of promoting atomization of the fuel. Between atomizer assembly 51 and O-ring 44, socket 32 and fuel injector 30 co-operatively define an annular space 58. This space is communicated to atmospheric pressure via suitable means, including a passage 60 which intersects the sidewall of segment 42 in manifold 34. Greater detail of atomizer assembly 51 is revealed in FIGS. 2, 3, and 3A.

Both parts 52 and 54 are thimble-shaped. Outer part 52 comprises a circular cylindrical sidewall 62 and a transverse circular end wall 64 that closes one axial end of the sidewall while the opposite axial end is left open. A frusto-conical shaped hole 66 is centrally disposed in end wall 64. Inner part 54 comprises a sidewall 68 that is closed at one axial end by a transverse end wall 70 while the opposite axial end remains open. A circular hole 71 extends centrally through end wall 70. Sidewall 68 and end wall 70 are provided with particular features.

Sidewall 68 comprises a number of parallel, circumferentially uniformly spaced apart, identical channels 72 in its radially outer face, eight channels for this particular example. Each channel 72 may be considered generally rectangular in cross section and of a circumferential extent that is approximately the same as the circumferential extent of each of the two immediately adjacent ridges 74 that space it from immediately adjacent channels 72.

End wall 70 comprises a central circular boss 76 on its exterior face. Boss 76 contains four channels 78 that are arranged in a symmetrical manner. Each channel 78 has a generally semi-circular cross section and extends in a straight line from hole 71 to the circumferentially outer terminus of boss 76. While channels 78 may be considered to be spaced ninety degrees circumferentially apart, the axis of each does not lie exactly on a radial. Rather, the axis of each channel 78 lies on an imaginary line that is spaced a small distance from, but parallel to, a corresponding radial that is ninety degrees circumferential of immediately adjacent radials with which the axes of immediately adjacent channels 78 are respectively spaced in like manner. In this way each channel 78 may be considered to intersect hole 71 in a somewhat tangential fashion.

Figure 2:
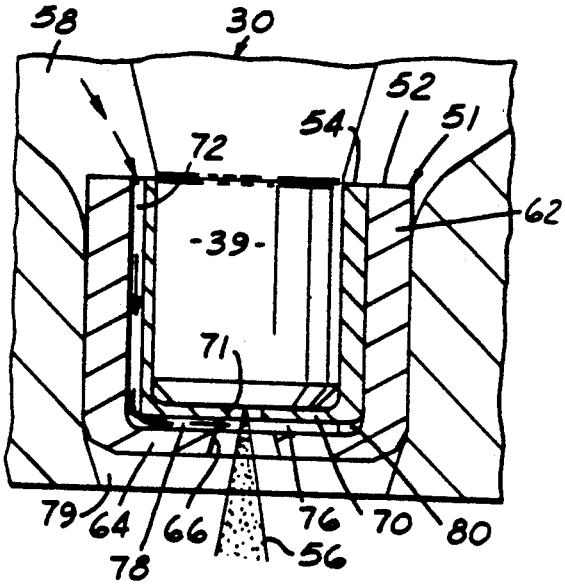
FIG. 2 is an enlarged view of a portion of FIG. 1.

In the assembled relation shown in FIGS. 1 and 2, inner part 54 nests snugly within outer part 52, and end walls 64 and 70 are in mutual abutment. Inner part 54 fits snuggly over the end of injector tip end 39, and the interior face of end wall 70 is in abutment with tip end 39. Outer part 52 fits snugly into segment 48, and the axially innermost end of socket 32 includes a radially inwardly directed lip 79 that is abutted by part 52 to relative to the socket at their assembly into the socket via the larger axially outermost end of the socket.

The manner in which atomizer assembly 51 functions can now be explained. When the engine is operating, the pressure in induction passage 50 is sub-atmospheric. Hence, a pressure differential exists across the atomizer assembly, and this differential is effective to cause air from space 58 to enter channels 72, to pass axially through these channels to a circular annular zone 80 which surrounds boss 76 and is defined within the atomizer assembly by the two assembled parts 52 and 54, to pass radially inwardly from zone 80 through channels 78, and to exit via hole 66. Fuel that is sprayed from the injector outlet 38 passes through the aligned holes 71 and 66 to enter induction passage 50. The air that passes through atomizer assembly 51 in the manner just described acts on the fuel spray 56 as it is being emitted from the injector tip end to assist in the atomization of the liquid fuel entering induction passage 50. Because of the tangential arrangement of channels 78 to holes 71 and 66, a swirling component of motion may be imparted to the assist air acting on the injected fuel leaving the injector, and such swirling may be beneficial in certain uses of the invention.

Atomizer assembly 51 is advantageous because it can be used directly with an otherwise conventional fuel injector without the need to modify the injector to accept the assembly. Likewise, special accommodations are unnecessary in socket 32 other than dimensioning bore segment 48 to accept the atomizer assembly. The snug fit of the atomizer assembly to the socket can provide sufficient sealing so that air in space 58 does not by-pass the intended flow path through the atomizer assembly. Likewise, the snug fit of inner part 52 on tip end 39 also provides sufficient sealing between the two. Such sealing can be achieved by suitable selection of constituent materials for the several parts involved.

Figure 3:
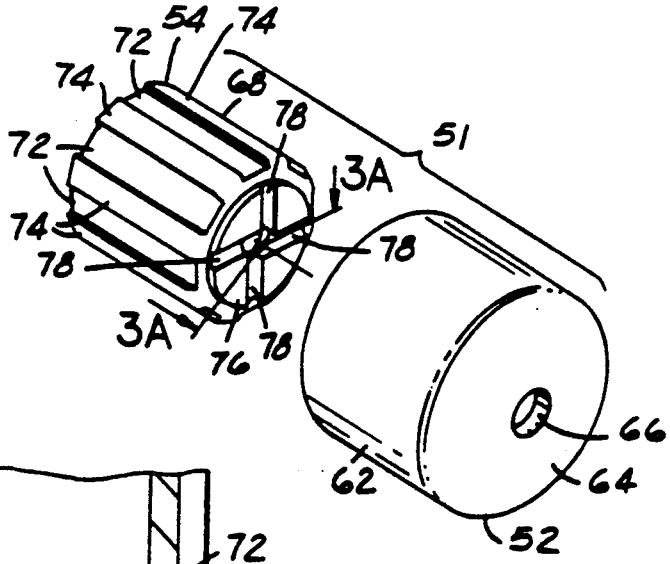
FIG. 3 is an exploded perspective vie of the air assist atomizer of FIG. 1.
Figure 3A:
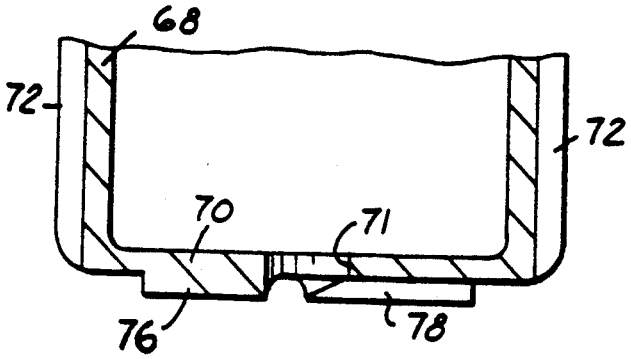
FIG. 3A is an enlarged fragmentary cross-sectional view in the direction of arrows 3A—3A of FIG. 3.
Figure 4:
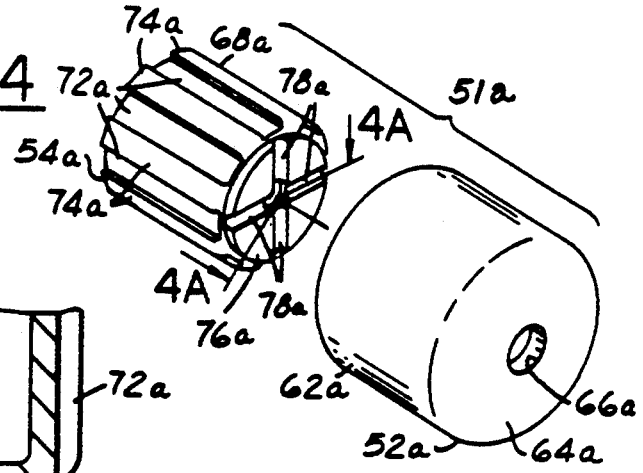
FIG. 4 is an exploded perspective view of another embodiment of the air assist atomizer.
Figure 4A:
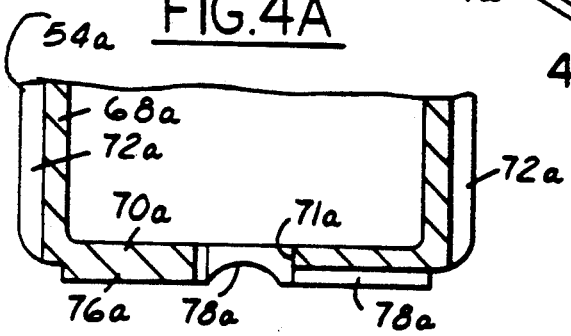
FIG. 4A is an enlarged fragmentary cross-sectional view in the direction of arrows 4A—4A of FIG. 4.

FIGS. 4 and 4A disclose a second embodiment of atomizer assembly 51*a* in which parts corresponding to those of FIGS. 3 and 3A are identified by the same numerals with the addition of the suffix The sole difference between assemblies 51 and 51*a* is that assembly 51*a* has the axes of channels 78*a* lying on, rather than spaced slightly from, radials. In this way the channels 78*a* are truly radial to hole 71*a*. The channels 78*a* are aimed straight at the center of the fuel jet to shear it into smaller particles.

Figure 5:
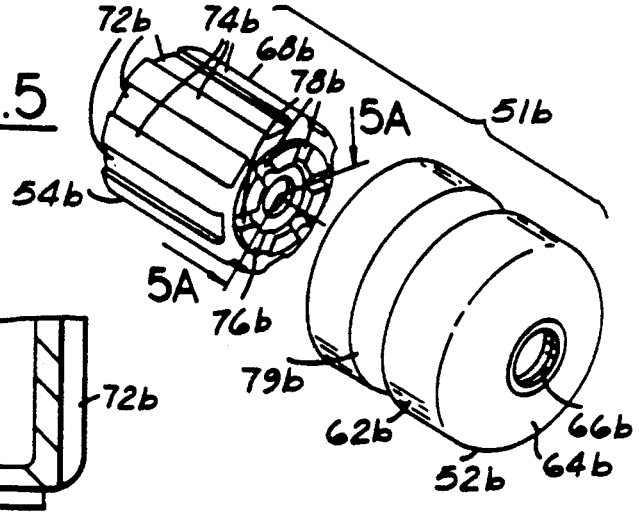
FIG. 5 is an exploded perspective view of still another embodiment of the air assist atomizer.
Figure 5A:
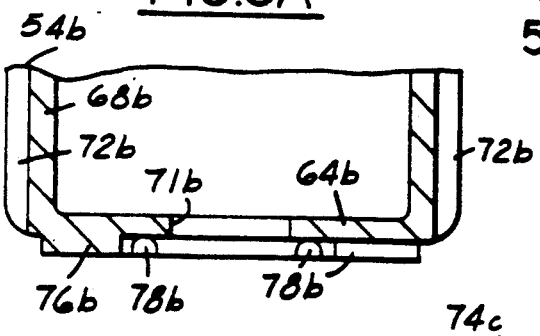
FIG. 5A is an enlarged fragmentary cross-sectional view in the direction of arrows 5A—5A of FIG. 5.

FIGS. 5 and 5A disclose a third embodiment of atomizer assembly 51b in which parts corresponding to those of FIGS. 3 and 3A are identified by the same numerals with the addition of the suffix b. The sole differences between parts 54a and 54 are that part 54b has an annular-shaped boss 76b and six channels 78b whose the axes lie on, rather than spaced slightly from, radials. In this way the channels 78b are truly radial to hole 71b, but are shorter in length than their counterparts in the first embodiment. Part 52b has a groove 79b that can accept an O-ring seal (not shown) to provide sealing between the socket and the atomizer assembly. This embodiment will operate to produce a thin annular airflow pattern acting on the fuel jet leaving the injector tip end.

Figure 6:
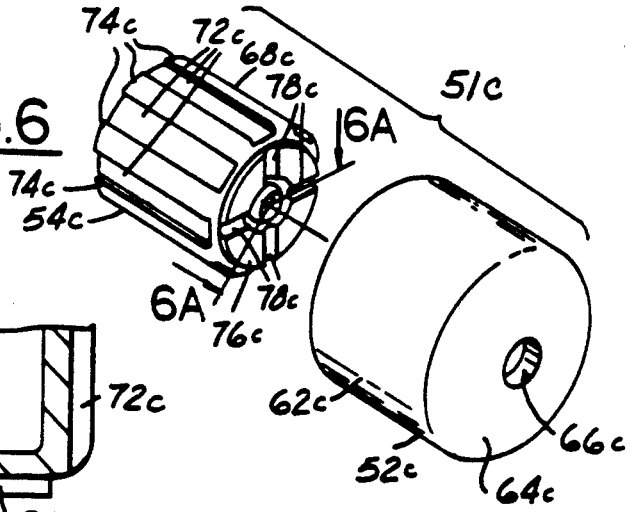
FIG. 6 is an exploded perspective view of yet another embodiment of the air assist atomizer.
Figure 6A:
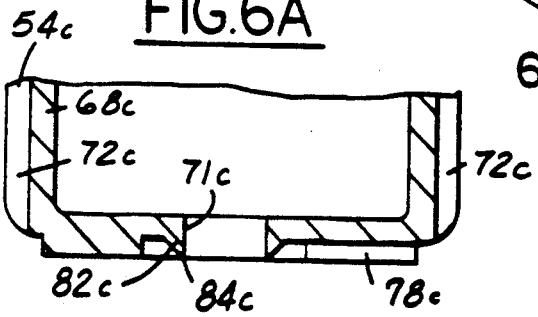
FIG. 6A is an enlarged fragmentary cross-sectional view in the direction of arrows 6A—6A of FIG. 6.

FIGS. 6 and 6A disclose a fourth embodiment of atomizer assembly 51c in which parts corresponding to those of FIGS. 4 and 4A are identified by the same numerals with the suffix c instead of the suffix a. The sole differences between assemblies 51a and 51c are that assembly 51c has an annular-shaped boss 76c whose radially inner face is spaced radially outwardly of hole 71b, so that channels 78c are shorter in length than channels 78a, and an integral circular ring 82c of triangular-shaped cross section is formed in part 54c at the end of hole 71c to form a continuation thereof while providing a sharp circular edge 84c that lies in the plane of the axial end face of boss 76c. This sharp-edged ring will serve to direct the air leaving channels 78c and create high turbulence in the region of the fuel stream.

Figure 7:
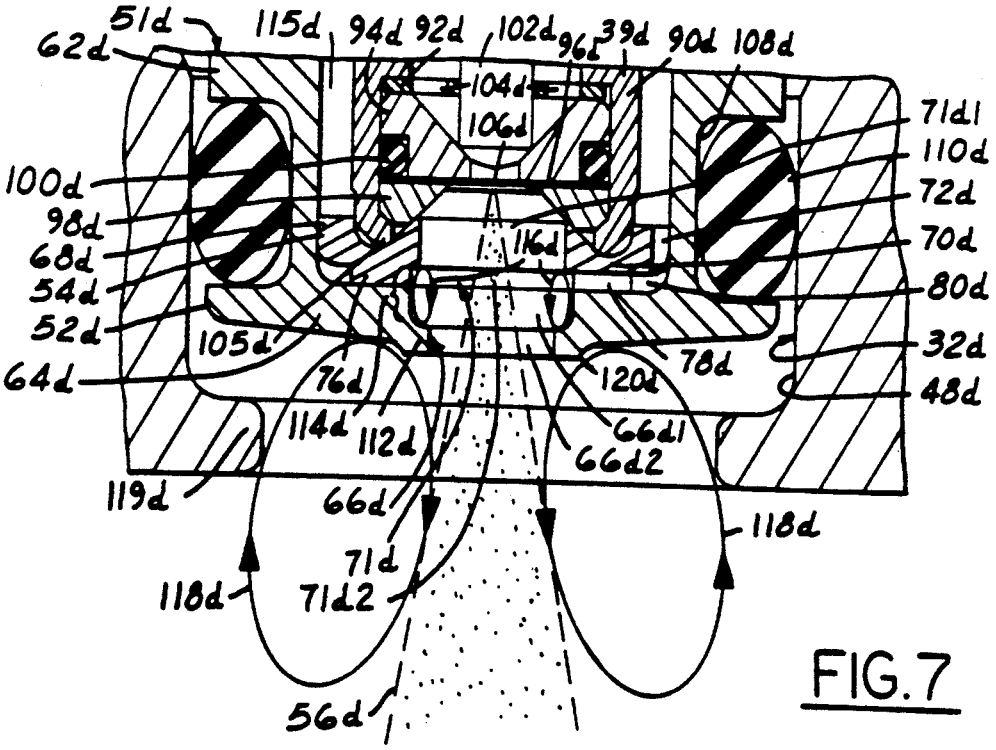
FIG. 7 is a fragmentary longitudinal cross-sectional view through a manifold socket containing a fuel injector having a further embodiment of the air assist atomizer of the present invention.

FIG. 7 shows a fifth embodiment of atomizer assembly 51d which differs in a number of ways from the first four embodiments. Elements in FIG. 7 which correspond to elements in the earlier Figs. are identified by the same base numeral but with the suffix d. Thus the two parts of atomizer assembly 51d are an outer part 52d and an inner part 54d. Part 52d comprises a side wall 62d, an end wall 64d, and a hole 66d through end wall 64d. Part 54d comprises a sidewall 68d, an end wall 70d, and a hole 71d through end wall 70d.

FIG. 7 also shows certain detail of the interior of the injector tip end 39d. Axially captured within a cylindrical body side wall 90d are a needle guide member 92d, a seat member 94d, a thin disc orifice member 96d, and a back-up ring 98d. Seat member 94d contains a circular groove which receives an O-ring seal 100d for sealing the seat member to the cylindrical body side wall. A needle 102d passes through a central circular guide hole in member 92d and seats on member 94d when the solenoid of the injector (not appearing in FIG. 7) is not energized. When the solenoid is energized, needle 102d lifts from member 94d to allow the pressurized fuel that has been introduced into the fuel injector to flow along a path including holes 104d in member 92d, through a central hole in member 94d, and through one or more orifices 106d in member 96d. The fuel passes from the injector tip end through the space that is circumferentially bounded by back-up ring 98d and a taper 105d at the distal end of sidewall 90d that axially captures the assembled parts 92d, 94d, 96d, and 98d within the injector tip end.

For sealing of the atomizer assembly to the wall of socket 32d, sidewall 62d contains a circumferential groove 108d around its outside, and an O-ring seal 110d is seated in groove 108d. The axially outer face of end wall 64d has a slight crown that includes at the center a circular boss 112d. Hole 66d comprises two segments: a larger diameter axially inner segment 66d1 and a smaller diameter axially outer segment 66d2.

Part 54d has a shape that is more disc-like than thimble-like. Its sidewall 68d is quite short but does include a series of axial channels 72d. It also has a circular annular boss 76d that contains a series of radial channels 78d. Inner part 54d snugly nests within outer part 52d with boss 76d abutting end wall 64d. The two parts 52d and 54d are constructed to provide the annular space 80d via which channels 72d communicate with channels 78d. The axially inner face of end wall 70d of part 54d is shaped to pass through the space that is circumscribed by taper 105d and fit against the frusto-conical tapered I.D. surface of back-up ring 98d in the manner shown. Hole 71d comprises two segments: a smaller diameter axially inner segment 71d1 and a larger diameter axially outer segment 71d2. Segments 71d2 and 66d1 have the same diameters and cooperatively define an axial zone 114d that may be considered in the form of an annular undercut in the passage that is cooperatively defined by holes 66d and 71d. An annular space 115d surrounds the injector tip end proximally of the atomizer assembly and is suitably communicated to atmospheric pressure to provide for assist air to the atomizer assembly at the entrances of channels 72d.

The configuration of FIG. 7 is advantageous in that it discourages the collection of fuel on adjacent surfaces which otherwise may form to a droplet size which can drip into the induction air passage and cause an undesirable rise in certain engine exhaust constituents such as hydrocarbons. Observed and calculated airflow patterns that are due to the atomizer assembly include two toroidal recirculation regions which are respectively identified by the numerals 116d and 118d. The inner recirculation region 116d forms at the undercut of zone 114d. This recirculation takes smaller fringe particles of fuel and redirects them into the air discharge passing from channels 78d to holes 66d and 71d. The outer recirculation region 118d extends through the open inner end of socket 32d, which is circumscribed by a lip 119d, and removes small fuel droplets from the fringes of the injection stream 56d and centrifuges them back onto the crowned end wall of part 52d. Vibration forces and the air velocity cause the collected fuel to travel toward a sharp edge 120d bounding the rim of boss 112d. This sharp edge tends to shear the collected fuel with the result that the sheared fuel is carried away into the flow stream.

Figure 8:
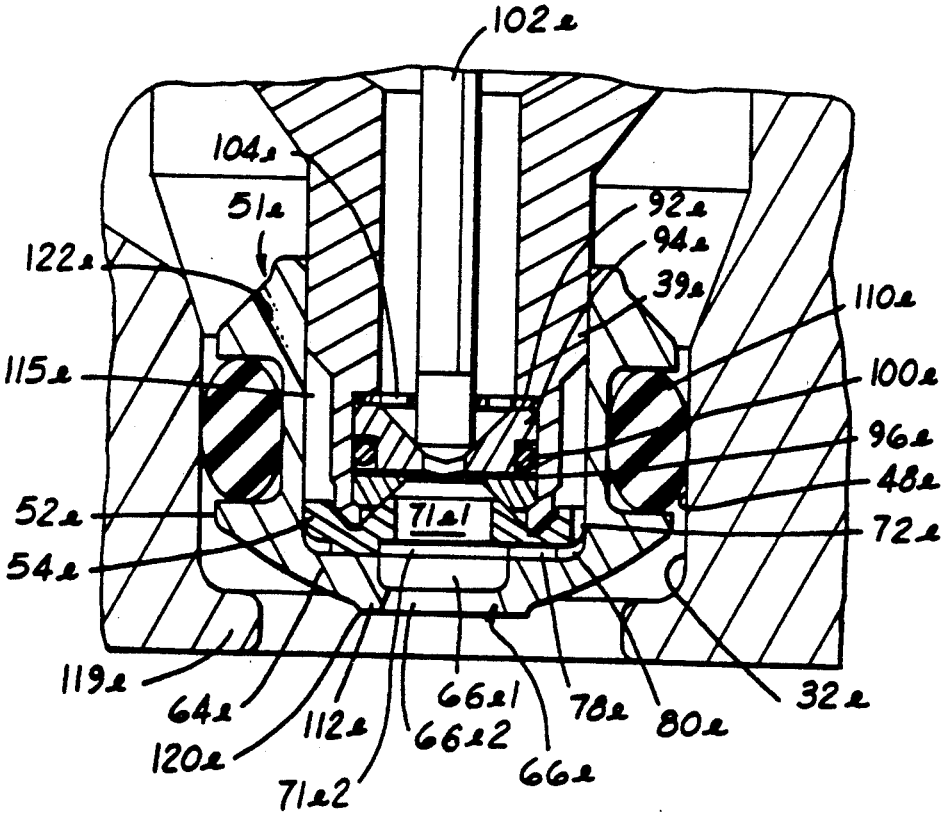
FIG. 8 is a view similar to FIG. 7 of a still further embodiment.
Figure 9:
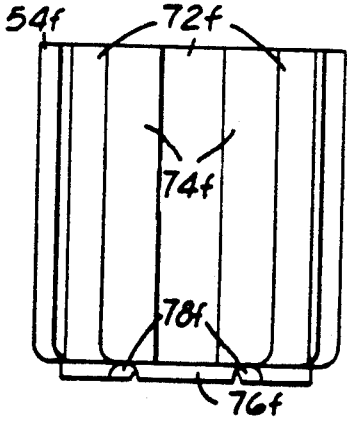
FIG. 9 is a side elevational view of one part of yet a further embodiment of air assist atomizer.
Figure 12:
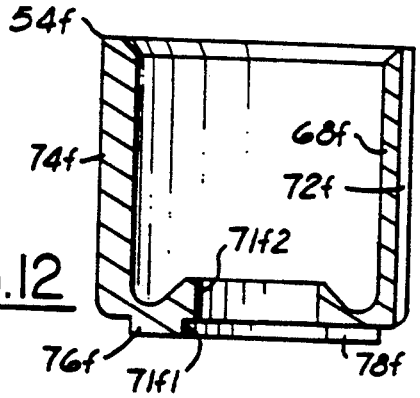
FIG. 12 is a cross-sectional view taken in the direction of arrows 12—12 in FIG. 10.
Figure 10:
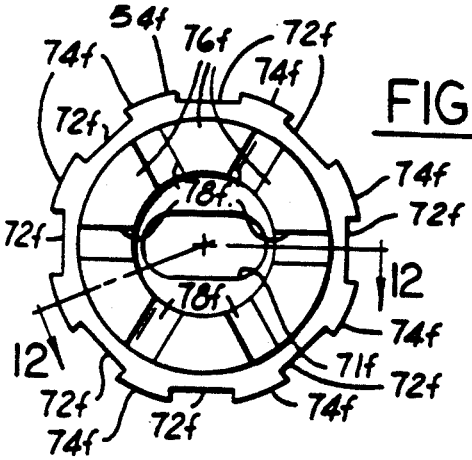
FIG. 10 is a bottom end view of FIG. 9.
Figure 11:
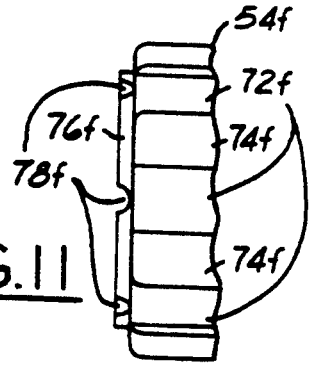
FIG. 11 is a fragmentary right side view of FIG. 10.

The embodiment of FIG. 8 is like that of FIG. 7 with the exception of certain portions of the shapes of the two parts of the atomizer assembly. In FIG. 8, elements that correspond to those of FIG. 7 are identified by the same base reference number but with the suffix e. The primary difference is that the end wall 64e of part 52e has a larger crown so that boss 112e, including sharp edge 120e are disposed axially so as to be circumferentially bounded by lip 119e. Segment 66e2 of hole 66e also has a frusto-conical shape that expands in the direction of flow. FIG. 8 also reveals further details that show one or more holes 122e in part 52e that serve to communicate space 115e to atmospheric pressure. One further difference is that the thin disc orifice member 96e has a central depending cone containing the orifices so that the flow through each orifice is at an angle to the injector's longitudinal axis. While end wall 64e is closer to the induction passage than is the case for end wall 64d in FIG. 7, and therefore does not tend to create regions like regions 118d in FIG. 7, there is less of a tendency for this FIG. 8 embodiment to collect droplets on the exterior face of end wall 64e which could ultimately form into a larger drop that might drip into the induction passage, and therefore a configuration like that of FIG. 8 is likely to be preferred over one like FIG. 7.

Figure 15:
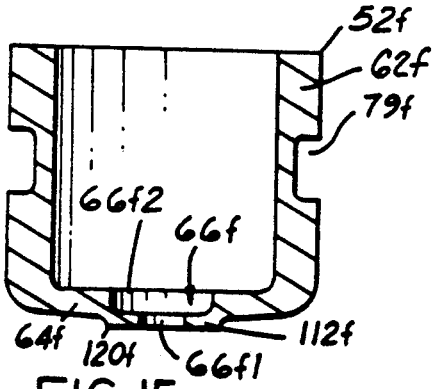
FIG. 15 is a cross-sectional view taken in the direction of arrows 15—15 in FIG. 14.
Figure 13:
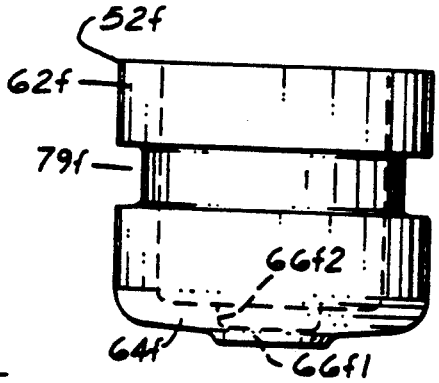
FIG. 13 is a side elevational view of another part of the embodiment of air assist atomizer referred to in FIG. 9.
Figure 14:
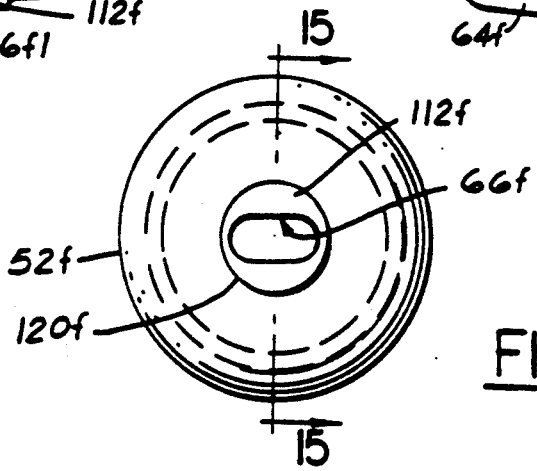
FIG. 14 is a bottom end view of FIG. 13.
Figure 16:
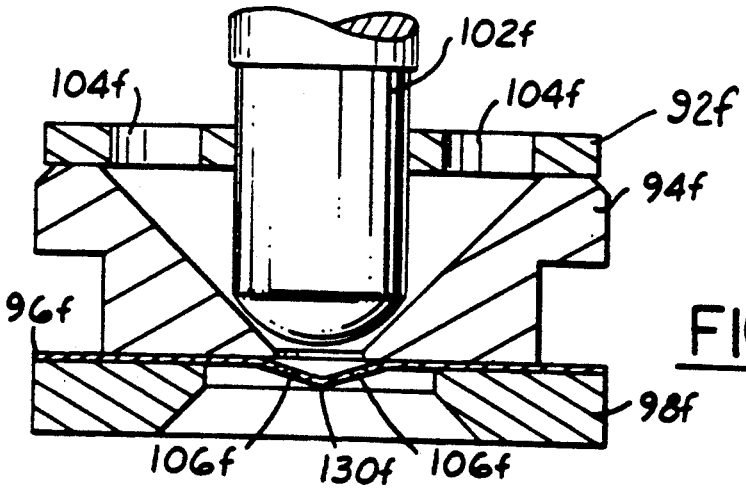
FIG. 16 is a view similar to the view of FIG. 7, but is intended for use with the embodiment of FIGS. 9-15.
Figure 17:
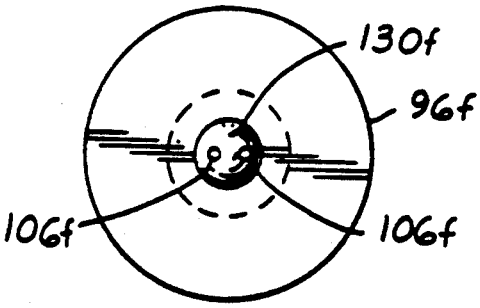
FIG. 17 is a bottom view of a portion of FIG. 16.
Figure 19:
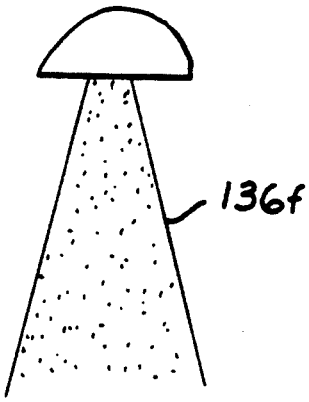
FIG. 19 is a view similar to FIG. 18, but illustrating another mode of operation.
Figure 18:
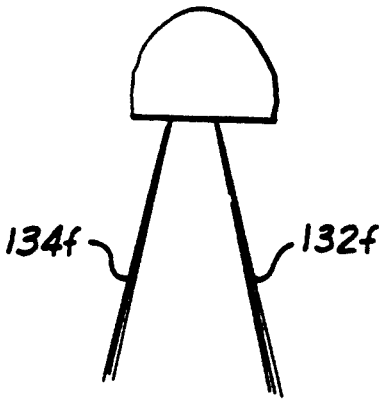
FIG. 18 is a fragmentary side elevational view illustrating one mode of operation for the embodiment of FIGS. 9-17.

FIGS. 9–15 present a seventh embodiment of atomizer assembly which consists of an inner part 54*f* (FIGS. 9–12) and an outer part 52*f* (FIGS. 13–15, which are on a slightly reduced scale from the scale of FIGS. 9–12). Elements of this seventh embodiment which correspond to elements of the previous embodiment are identified by the same base numeral, but with the suffix f. As in the previous embodiments, part 54*f* nests snugly within part 52*f*, and boss 76*f* abuts end wall 64*f*. This seventh embodiment is most like the embodiment of FIGS. 5 and 5A; it differs from that embodiment however in that segment 66*f*1 of hole 66*f* has the shape of an elongated circle, i.e. a race-track shape, and hole 71*f* is congruent with segment 66*f*1. Atomizer assembly 51*f* is intended to be, and is in fact, used with a split-stream fuel injector whose tip end is like that illustrated in FIGS. 16 and 17. The elements of FIG. 16 which correspond to those of previous embodiments are designated by the same base numeral but with the suffix f. The thin disc orifice member 96*f* comprises a central conical depression 130*f* which contains two orifices 106*f* diametrically opposite each other. When the assist air is unavailable, either by control strategy or by lack of sufficient pressure differential, and the fuel injector is operated, fuel is emitted in the fashion of FIG. 18 to comprise two distinct divergent streams. The long dimensions of both hole segment 66*f*1 and hole 71*f* lie in the plane of FIG. 18. When the air assist is turned on and the injector operated, the injected fuel from the two orifices is nebulized into a fan shape 136*f* in the fashion schematically portrayed by FIG. 19. The shapes of hole segment 66*f*1 and hole 71*f* allow the nebulized fan pattern to pass into the engine induction passage. Switching from one mode to the other can be accomplished with a particular control strategy simply by switching the air assist on or off as the case may be, and this could be done by a valve disposed in the assist air path upstream of all injectors, with the valve being controlled by the engine control computer, and/or by an air pump, which may also be controlled by control strategy from the computer.

Figure 20:
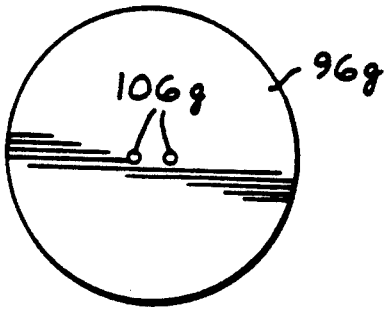
FIG. 20 is a view similar to FIG. 17, but showing a modified form.

FIG. 20 shows a thin disc orifice member 96*g* which is flat throughout and contains orifices 106*g* in diametrically opposite halves. An atomizer assembly consisting of parts 52*f* and 54*f* can also be advantageously used with a fuel injector containing the orifice disc of FIG. 20.

Calibration of the atomizer assemblies to achieve proper assist air flow is accomplished by the number and the sizing of the channels, particularly the channels identified by the base numeral 78. It is possible to accomplish calibration during the process of assembling the two parts of the atomizer assembly together. Fabrication of the atomizer assembly parts can be conducted by conventional procedures, and both machining and powdered metallurgy are contemplated. The use of any particular process will depend on several factors including dimensions and relative proportions. In order to handle flex-fuel applications, the atomizer parts are preferably stainless steel; if powdered metal parts are used, they may be coated, or plated, in a suitable manner. When the atomizer assemblies of the invention are used in an engine which relies upon atmospheric air as the source of assist air, the flow of assist air through the atomizer assembly will be a function of the vacuum level in the induction passage. At large manifold vacuums, the flow of assist air will be greater while at lesser vacuum levels, the flow of assist air will diminish. The exact design details of any given atomizer assembly embodying the inventive principles can be created with the use of conventional engineering calculations.

Figure 21:
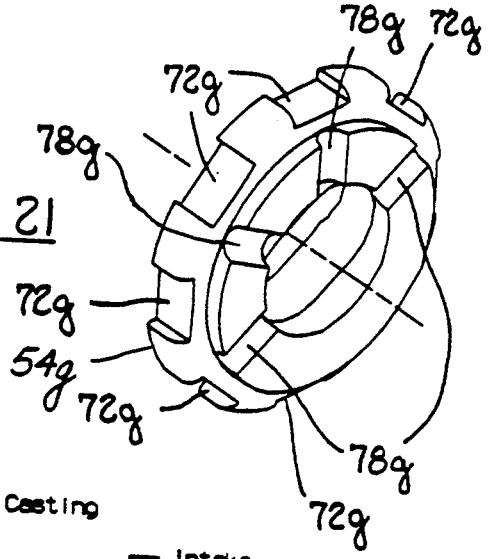
FIG. 21 is a bottom end view of a part of yet another embodiment of the air assist atomizer.
Figure 22:
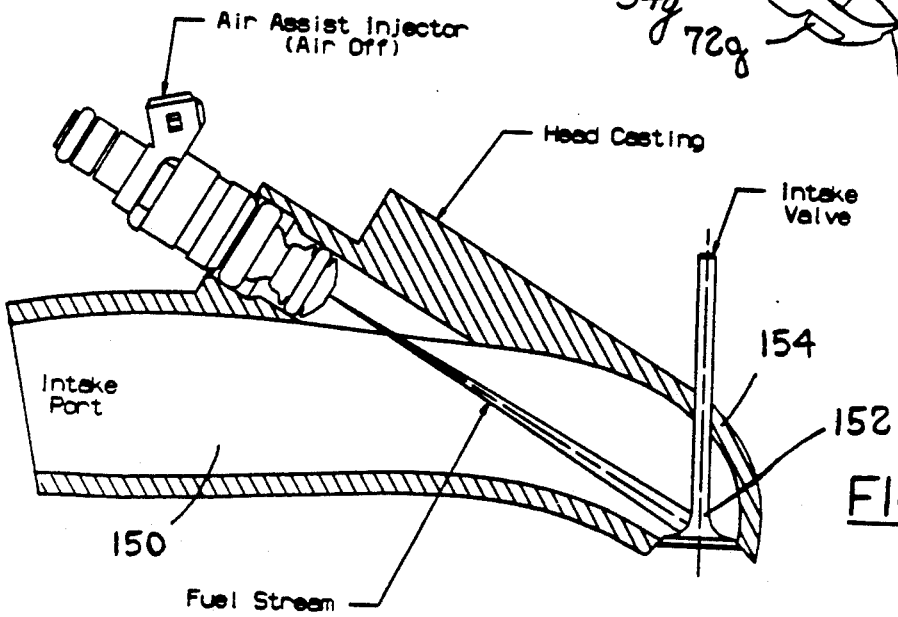
FIG. 22 is a cross-sectional view through the intake manifold showing the fuel injector having the air assist atomizer of FIG. 21 with the air assist turned off.
Figure 23:
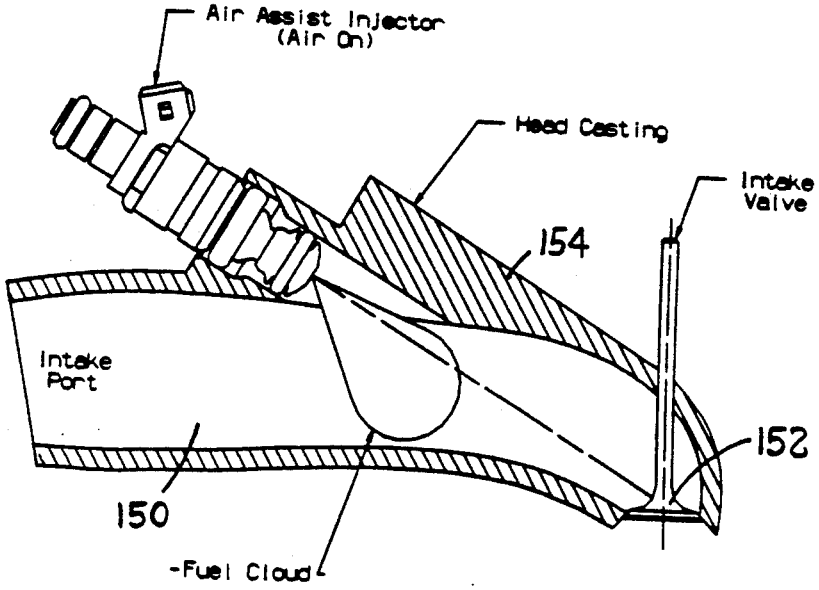

FIGS. 21, 22, and 23 relate to yet another embodiment. FIG. 21 shows the end portion of an inner atomizer part 54*g* that cooperates with the injector tip end 39 and with an outer atomizer part (not shown in FIG. 23, but like one of the parts 52*a*, 52*b*, or 52*c*.) Part 54*a* has a circumferentially symmetrical pattern of channels 72*g*, but a circumferentially asymmetrical pattern of channels 78*g*. The asymmetrical circumferential pattern of channels 78*g* is arranged with none of the channels 78*g* disposed within a certain circumferential span, slightly less than 180 degrees, such that the atomized fuel emitted from the injector outlet is emitted as a cloud that is skewed radially toward that certain circumferential span. FIGS. 22 and 23 illustrate the air-assisted fuel injector installed in a passage 150 leading toward a cylinder intake valve 152 of an internal combustion engine 154. FIG. 22 shows that when the air assist is off, the fuel injector emits a pencil stream of injected fuel toward the head of the intake valve. Such aiming is especially desirable for non-air-assisted operation. When the air assist is on, the injected fuel forms a cloud as in FIG. 23 wherein the cloud is skewed, or bent, relative to the line of the pencil stream. The skewed air-assisted cloud that is achieved by the asymmetrical pattern of channels 78*g* is advantageous because it minimizes wall wetting that would otherwise occur without the bending of the cloud due to the particular geometry of passage 150 and the orientation of the fuel injector relative to passage 150. This embodiment of the invention provides desirable patterns for the injected fuel in both air-assisted and non-air-assisted modes. It is an especially effective solution for engines where it is not feasible for injector orientation to be changed and the injector must be oriented in a manner like that shown in FIGS. 22 and 23. It is not essential that channels 72*g* be in a symmetrical pattern.

While a presently preferred embodiment of the invention has been illustrated and described, it should be appreciated that its principles may be practiced in other forms that are equivalent to the following claims.

What is claimed is:

1. In an internal combustion engine having an induction passage into which fuel is injected by an electrically operated fuel injector that is disposed in a socket which is located in a component of the engine and is communicated with said induction passage such that fuel emitted from an outlet in a tip end of the fuel injector enters said induction passage for entrainment with air flow in said induction passage to form a combustible mixture for combustion in a combustion chamber space of the engine, said engine also having air assist means for delivering assist air to said injector tip end to promote atomization of fuel emitted therefrom, said air assist means including an atomizer at said injector tip end, the improvement which comprises:

said fuel injector and said atomizer comprising means coacting, when the air assist means is off, for delivering a stream of injected fuel along a given direction that is substantially straight, and when the air assist means is off, for delivering a cloud of injected fuel along a direction that is skewed to said given direction.

2. In an internal combustion engine having an induction passage into which fuel is injected by an electrically operated fuel injector that is disposed in a socket which is located in a component of the engine and is communicated with said induction passage such that fuel emitted from an outlet in a tip end of the fuel injector enters said induction passage for entrainment with air flow in said induction passage for form a combustible mixture for combustion in a combustion chamber space of the engine, said engine also having air assist means for delivering assist air to said injector tip end to promote atomization of fuel emitted therefrom, said air assist means including an atomizer at said injector tip end, the improvement which comprises:

said atomizer comprising transverse wall structure disposed between said injector outlet and said induction passage and comprising an elongated hole for passage of fuel from said injector outlet to said induction passage and also comprising passage means for conveying assist air to said elongated hole for atomizing action on fuel emitted from said injector outlet, said passage means comprises circumferentially spaced apart channels distributed around said elongated hole for directing assist air to said elongated hole from a number of different directions, said injector outlet comprises plural orifices that emit distinct streams of fuel, and when assist air to the atomizer is shut off, said distinct streams of fuel pass through said elongated hole as distinct stream, but when assist air is conveyed to said atomizer, the action of the assist air on the distinct streams of fuel causes them to nebulize into a fanned out spray that also passes through said elongated hole.

3. In an internal combustion engine having an induction passage into which fuel is injected by an electrically operated fuel injector that is disposed in a socket which is located in a component of the engine and is communicated with said induction passage such that fuel emitted from an outlet in a tip end of the fuel injector enters said induction passage for entrainment with air flow in said induction passage to form a combustible mixture for combustion in a combustion chamber space of the engine, said engine also having air assist means for delivering assist air to said injector tip end to promote atomization of fuel emitted therefrom, said air assist means including an atomizer at said injector tip end, the improvement in said atomizer which comprises:

an inner part which is nested within an outer part, said outer part comprising a cylindrical side wall that is disposed in circumferentially surrounding relation to said injector tip end and in sealing relation to a cylindrical wall segment of said socket, said outer part further comprising an end wall disposed between said injector outlet and said induction passage, said inner part comprising a transverse wall disposed between said outer part's end wall and said injector outlet, said transverse wall and said end wall comprising holes for passage of fuel from said injector outlet to said induction passage, said inner and outer parts cooperatively defining space which is in circumferentially surrounding relation to said injector tip end and receives assist air, and said transverse wall of said inner part and said end wall of said outer part cooperatively define between themselves passage means which extends from said space to said holes to convey assist air for atomizing action on fuel emitted from said injector outlet.

4. The improvement set forth in claim 3 in which said passage means are arranged in an asymmetrical circumferential pattern wherein none of said passage means are disposed within a certain circumferential span such that the atomized fuel emitted from said injector outlet is emitted as a cloud that is skewed radially toward said certain circumferential span.

5. The improvement set forth in claim 3 in which said end wall has a crown that extends in the direction in which fuel is emitted.

6. The improvement set forth in claim 5 in which said crown extends to an annular boss in said end wall, said annular boss having a sharp annular edge.

7. The improvement set forth in claim 3 in which said passage means comprises circumferentially spaced apart radially extending channels.

8. The improvement set forth in claim 7 in which said radially extending channels are straight and comprise axes which lie on radials to a main longitudinal axis passing through said injector outlet.

9. The improvement set forth in claim 7 in which said radially extending channels are straight and comprise axes which are parallel to but spaced from radials to a main longitudinal axis passing through said injector outlet.

10. The improvement set forth in claim 7 in which a further annular zone of diameter less than that of said first-mentioned annular zone is disposed at the radially inner terminus of said passage means and is in surrounding relation to said holes.

11. The improvement set forth in claim 10 in which said inner part comprises an annular lip that is surrounded by said further annular zone and that terminates in a sharp annular edge.

12. The improvement set forth in claim 11 in which said holes are elongated in a particular direction, said injector outlet comprises plural orifices that emit distinct streams of fuel, and when assist air to the atomizer is shut off, said distinct streams of fuel pass through said holes as distinct streams, but when assist air is conveyed to said atomizer, the action of the assist air on the distinct streams of fuel causes them to nebulize into a fanned out spray that also passes through said holes.

13. The improvement set forth in claim 3 in which said inner part comprises a cylindrical sidewall that extends from said transverse wall and fits onto said injector tip end.

14. The improvement set forth in claim 13 in which said space comprises a circumferentially continuous annular zone that is defined in part by the junction of said outer parts's sidewall with said outer part's end wall.

15. The improvement set forth in claim 14 in which said space further comprises circumferentially spaced apart axially extending channels co-operatively defined by said sidewalls of said inner and outer parts for conveying assist air to said annular zone.

16. The improvement set forth in claim 15 in which said passage means comprises circumferentially spaced apart radially extending channels.

17. The improvement set forth in claim 16 in which said radially extending channels are straight and comprise axes which lie on radials to a main longitudinal axis passing through said injector outlet.

18. The improvement set forth in claim 16 in which said radially extending channels are straight and comprise axes which are parallel to but spaced from radials to a main longitudinal axis passing through said injector outlet.

19. The improvement set forth in claim 16 in which further annular zone of diameter less than that of said first-mentioned annular zone is disposed at the radially inner terminus of said passage means and is in surrounding relation to said holes.

20. The improvement set forth in claim 19 in which said inner part comprises an annular lip that is surrounded by said further annular zone and that terminates in a sharp annular edge.

* * * * *